US009113275B2

(12) United States Patent
Klem

(10) Patent No.: US 9,113,275 B2
(45) Date of Patent: Aug. 18, 2015

(54) HEARING AID SECURITY AID

(71) Applicant: Linda Klem, Wakefield, MA (US)

(72) Inventor: Linda Klem, Wakefield, MA (US)

( * ) Notice: Subject to any disclaimer, the term of this patent is extended or adjusted under 35 U.S.C. 154(b) by 0 days.

(21) Appl. No.: 14/470,485

(22) Filed: Aug. 27, 2014

(65) Prior Publication Data

US 2015/0092970 A1 Apr. 2, 2015

Related U.S. Application Data

(60) Provisional application No. 61/885,691, filed on Oct. 2, 2013.

(51) Int. Cl.
*H04R 25/00* (2006.01)

(52) U.S. Cl.
CPC ..... *H04R 25/556* (2013.01); *H04R 2225/021* (2013.01)

(58) Field of Classification Search
CPC ..... H04R 25/60; H04R 25/65; H04R 25/00; H04R 2225/023; H04R 2225/025; H04R 1/105; H04R 2225/021; H04R 2225/63; H04R 2460/13; H04R 1/1016
USPC ..... 381/322, 324, 327–328, 330, 380–381
See application file for complete search history.

(56) References Cited

U.S. PATENT DOCUMENTS

| | | | | |
|---|---|---|---|---|
| 2,506,226 | A | 5/1950 | Starkey | |
| 5,327,499 | A * | 7/1994 | Sohayda | 381/322 |
| 5,533,130 | A | 7/1996 | Staton | |
| 5,812,680 | A * | 9/1998 | Glendon | 381/322 |
| 8,011,783 | B1 | 9/2011 | Le Blang | |
| 8,848,959 | B1 * | 9/2014 | Richter | 381/330 |
| 2010/0058560 | A1 | 3/2010 | Scott | |

FOREIGN PATENT DOCUMENTS

| | | |
|---|---|---|
| CA | 2781814 | 12/2013 |
| DE | 202004004086 | 6/2004 |
| DE | 102010021184 | 11/2011 |
| WO | 2007027467 | 6/2007 |

* cited by examiner

*Primary Examiner* — Suhan Ni
(74) *Attorney, Agent, or Firm* — Lambert & Associates; Gary E. Lambert; David J. Connaughton, Jr.

(57) ABSTRACT

A hearing aid safety aid is provided. The hearing aid is configured to attach a hearing aid to an earring of the wearer. If the hearing aid comes loose and falls off, the hearing aid safety aid prevents it from falling off the user by its connection to the user's earring.

19 Claims, 3 Drawing Sheets

HEARING AID SECURITY AID

BACKGROUND OF THE INVENTION

1. Field of the Invention

The present invention relates generally to hearing aid safety aids. More particularly, the present invention relates to a hearing aid safety aids having a chain that connects to a hearing aid component at one end, and that loops over an earring post at an opposite end.

2. Description of Related Art

Behind the ear (BTE) hearing aids have created a convenient and effective solution to provide hearing for many individuals. Such hearing aids rely on placing a hearing aid base behind the ear and placing a receiver into the ear canal, a receiver connecting the base to a dome at a distal end of the receiver, which is configured to fit in an ear canal of the user. The receiver and dome interact with the ear and hold the hearing aid in place. However, such hearing aids are only held in place by the dome in the ear canal. This, coupled with the fact that hearing aids are small and very light weight, makes it easy for the hearing aid to fall off and be lost before the wearer can notice.

Examples of situations where a hearing aid may easily be dislodged and lost include, but are not limited to: exercising, removing eye glasses, putting on and taking off hats, clothing, and the like, hair grooming, and the like. Further, simple everyday movements and use can cause the hearing aid to become dislodged.

Therefore, what is needed is a simple device that can help keep the hearing aid from being lost by the wearer without modification of the hearing aid.

SUMMARY OF THE INVENTION

The subject matter of this application may involve, in some cases, interrelated products, alternative solutions to a particular problem, and/or a plurality of different uses of a single system or article.

In one aspect, a hearing aid assembly is provided. The assembly comprises a hearing aid which includes a base and a receiver, the receiver having a dome at its distal end for insertion into an ear canal of the user, and connecting the dome to the base. The assembly further comprises a hearing aid safety aid which includes a flexible elongate member, a small ring on a first end of the member, and a large ring on the opposite end of the member. The large ring defines an interior aperture large enough for the small ring to pass through. In use, the hearing aid safety aid is looped around the receiver of the hearing aid by the small ring being passed through the large ring about the receiver, forming a slip knot over the receiver. The small loop is passed over an earring post, and the earring is secured to a user's ear. As such, if the hearing aid were to fall off, it would be secured to the user by being secured to the earring post of the earring in the user's ear.

DETAILED DESCRIPTION

Figure 1:
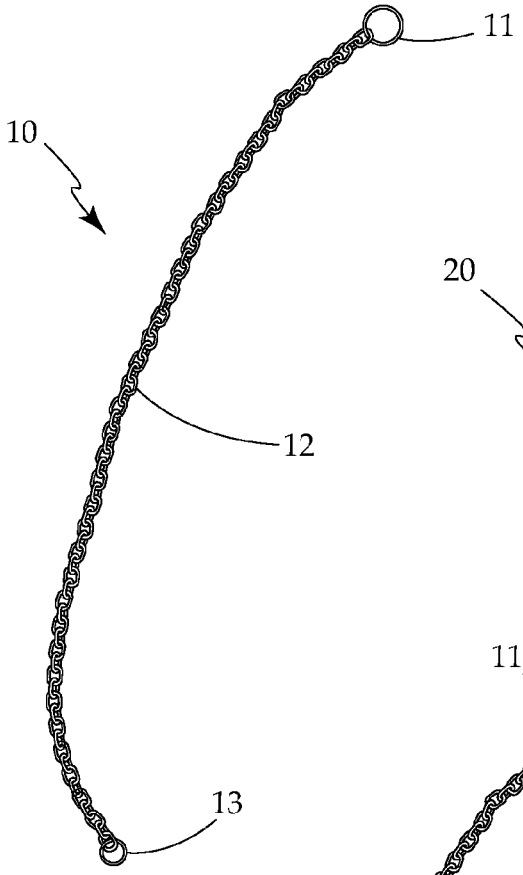
FIG. 1 provides a perspective view of an embodiment of the hearing aid safety aid.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention concerns a hearing aid safety aid formed as a chain or similar cord that is designed to prevent the loss of a BTE hearing aid by connecting it to an earring worn by a user. In operation, if the hearing aid falls off a user's ear, the chain prevents it from falling off the user's head, keeping it secured to the user's body. The hearing aid safety aid is a device that prevents the loss of a BTE hearing aid by securing the hearing aid to an earring in the user's ear.

In one embodiment, at one end of the chain is a first small loop, and at the other end of the chain is a second large loop. The large loop is large enough for the small loop to pass through it, allowing it to form slip knots about a hearing aid element. The small loop defines an interior space large enough for an earring post to easily pass through. As such, the hearing aid may be secured to the earring by the safety aid forming a slip knot about a part of the hearing aid—preferably a receiver (such as a tube in acoustic embodiments, a wire in electronic embodiments, or other elongate structure to carry sound information from the base) of the hearing aid, securing the small loop to an earring post, and securing the earring post to the user's ear.

BTE hearing aids comprise a kidney shaped (or similar) base component that is positioned behind the ear when in use. Within the base are microphones and other components such as a battery. Attached to the base component is a shaped or molded receiver which may be a tube, a wire, or any other structure capable of transferring sound to from the base to the ear of the user. At the end of the receiver is a dome which completes the process of delivering sound to the user's ear when positioned in the user's ear canal. In use, the dome is positioned in the ear canal, and the receiver extends up over the top of the hearing aid to the base behind the ear. Thus, if the dome comes out of the user's ear, the hearing aid may easily fall off.

The hearing aid safety aid may be formed of any material capable of being attached to a hearing aid and earring, and capable of supporting a weight of a hearing aid. Generally, the chain or other elongate member of the safety aid is a flexible, elongate member. Examples of which the hearing aid safety aid may be formed of include, but are not limited to: chains, flexible cables, tubes, straps and the like formed of metals, plastics, natural fibers and materials, composites, and the like.

The term "earring post" as used herein may refer to any structure that connects an earring to a wearer's ear. For example, it may be a post, a wire, or any other structure. Thus, the term "earring post" includes not only earring posts, as such, but also any other structure connecting the earring to the user's ear.

The hearing aid safety aid may be any size and shape capable of being attached to a hearing aid and an earring, and capable of holding a weight of the hearing aid. In one particular embodiment, the hearing aid safety aid may be sized to be between 3 inches and 3.5 inches in length.

Turning now to FIG. 1, the hearing aid safety aid is shown. The hearing aid safety aid 10 has a base chain 12 (or similar elongate member). At an earring end of the chain 12 is a small loop 13. The small loop 13 is connected to an end of the chain 12 and defines an aperture through its interior. At a hearing aid end of the chain 12 is a large loop 11. The large loop 11 is connected to an opposite end of the chain 12 from the small loop 13 and defines an aperture through its interior. The large loop 11 aperture is large enough for the small loop 13 and chain 12 to pass through it. As such the hearing aid safety aid 10 is capable of forming a slip knot about an object such as a hearing aid.

Figure 2:
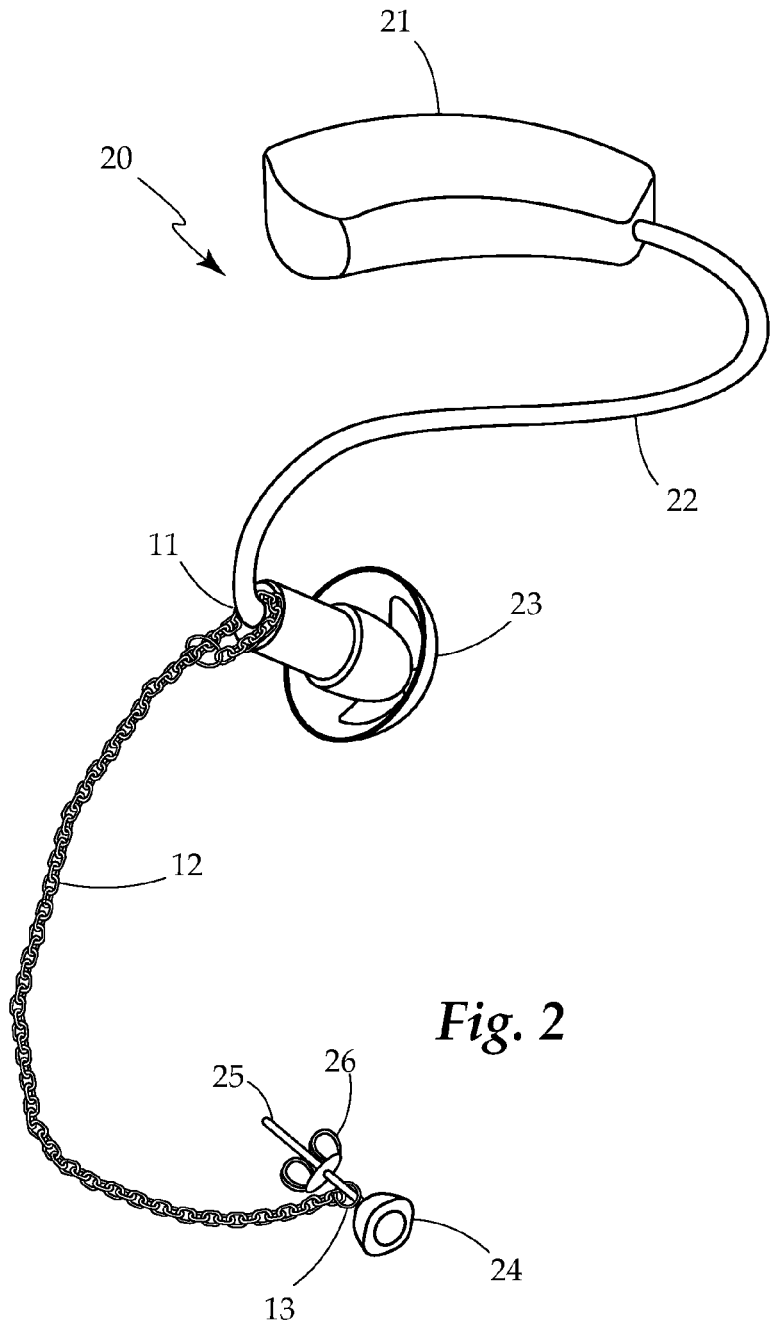
FIG. 2 provides a perspective view of an embodiment of the hearing aid safety aid in use.

FIG. 2 shows another embodiment of the hearing aid safety aid connected to a BTE hearing aid and an earring. In this view, the hearing aid safety aid 10 can be seen forming a slip knot about the receiver 22 of the hearing aid 20. The receiver connects base 21 to the dome 23. In operation, the base 21 is connected behind an ear of the user, and the dome 23 is positioned in the ear canal of the user. As can be seen, chain 12 and large loop 11 are forming a slip knot over receiver 22. This knot was formed by passing small loop 13 through the large loop 11 around the receiver 22. As small loop 13 is pulled through, it tightens the chain 12 and forms the knot. Small loop 13 is passed over an earring post 25 of an earring 24. The earring 24 has a charm such as a gemstone, metal or the like. The charm is larger than the small loop 13 aperture, and thus the small loop 13 cannot pass over the charm. Upon placing the backer 26 on the post 25, the small loop 13 is secured to the earring 24. In this embodiment in use, the small loop may be positioned in front of or behind the user's ear lobe (or any other part of a pierced ear). In embodiments wherein an earring does not have a backer 26, the small loop 13 will be positioned in front of the user's ear lobe, which will be sufficient to prevent the small loop 13 from coming off the earring post 25.

Figure 3:
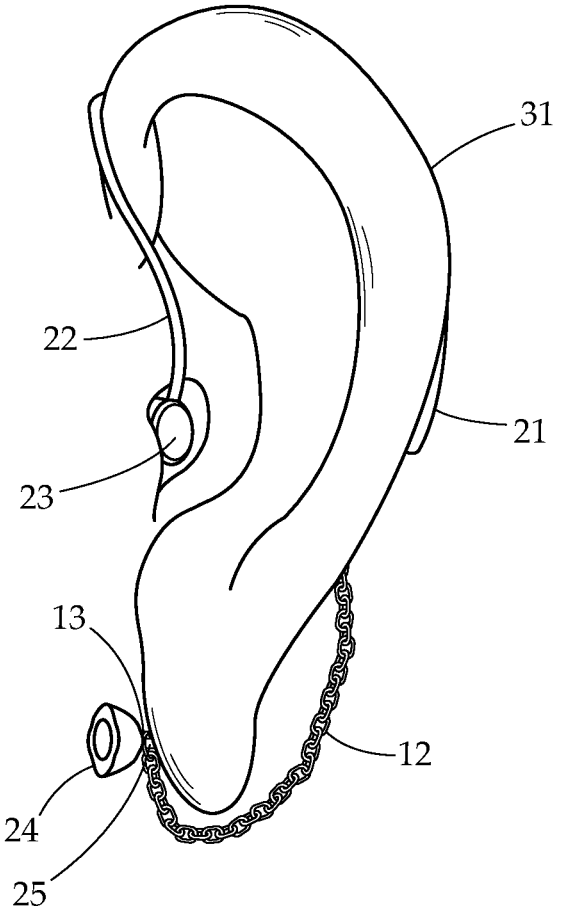
FIG. 3 provides a perspective view of an embodiment of the hearing aid safety aid in use.
Figure 4:
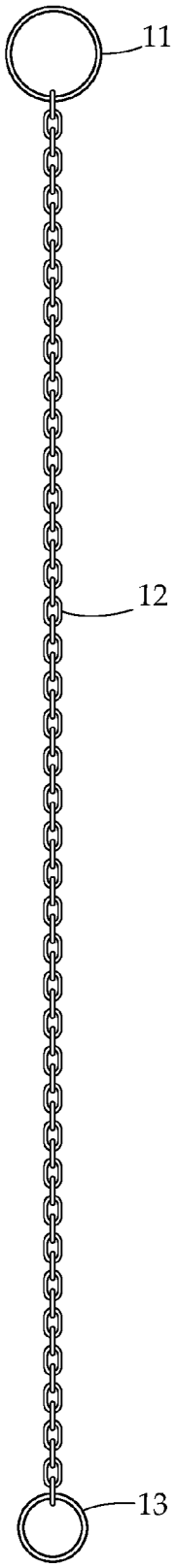
FIG. 4 provides an elevation view of a front of the hearing aid safety aid.
Figure 5:
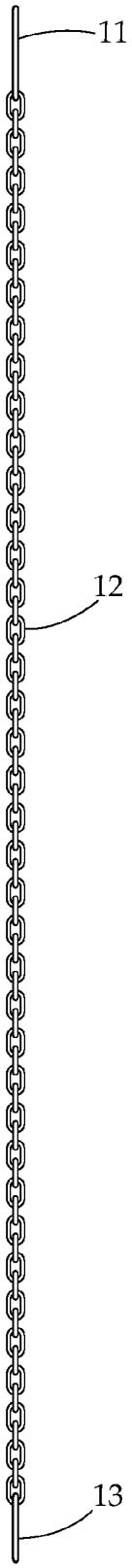
FIG. 5 provides an elevation view of a side of the hearing aid safety aid.
Figure 6:
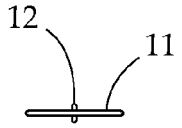
FIG. 6 provides an elevation view of a top of the hearing aid safety aid.
Figure 7:
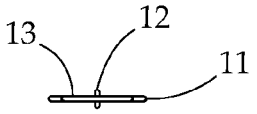
FIG. 7 provides an elevation view of a bottom of the hearing aid safety aid.

FIG. 3 provides a view of the hearing aid safety aid in use. In this view, the hearing aid is connected to the user's ear 31. The dome 23 is positioned within the ear canal. Receiver 22 loops over a top of the ear 31. Behind the ear is the base 21. Earring 24 is positioned through the pierced ear of the user. Small loop 13 is secured to the post 25 between the ear lobe and earring 24 front. The slip knot of the chain 12 is positioned behind the ear 31 and not shown in this view. In an alternative embodiment, the small loop 13 may be secured to the post behind the earlobe between the earlobe and earring backer (FIG. 2).

FIGS. 4-7 provide various views of an embodiment of the hearing aid safety aid. The chain 12 can be seen extended between the two ends. The large loop 11 is on one end, with the small loop 13 on the other end.

In an embodiment of use, a user may pass the small loop through the large loop about the receiver of the hearing aid forming a slip knot. In this position, the hearing aid safety aid is relatively secure. The hearing aid may be put on at this point, and then the small loop can be connected to an earring post, and the earring worn. Once the earring and hearing aid are in place on the user's ear, the hearing aid will be secured. In the event that the dome comes loose and the hearing aid falls off the ear, it will be caught by the hearing aid safety aid connected to the earring. This will prevent the hearing aid from becoming lost or broken from hitting the floor. It should be understood that various steps may be interchanged without straying from the scope of this invention. An additional advantage to the hearing aid safety aid is that it provides a tactile feedback that the hearing aid has come loose in that it pulls and tugs on the earlobe (or other section of the ear that is pierced) of the user if the hearing aid is dangling therefrom.

It should be understood that the present invention may include other embodiments connecting the hearing aid to the earring. For example, instead of a slip knot connection, the hearing aid safety aid may comprise a clip, hook, snap, or other similar connection that allows it to secure to the receiver or other portion of the hearing aid. In other embodiments, the connection of the hearing aid safety aid to the earring may vary from the ring passing over the post. For example, the hearing aid safety aid chain (or other member) may be permanently attached to the earring. In other embodiments, the hearing aid safety aid may clip, hook, snap or otherwise attach to any part of the earring. In still another embodiment, the chain may be directly attached to an earring back instead of the small ring. Further still, the safety aid may connect to other parts of the hearing aid such as the base or the dome. Indeed, any configuration capable of connecting any part of the hearing aid to any part of the earring is contemplated by the present invention.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A hearing aid assembly comprising:

a behind-the-ear hearing aid comprising a base, and an elongate receiver comprising a dome at a distal end, and connecting to the base at a proximal end, the behind-the-ear hearing aid connected to an ear of a user, having the dome in an ear canal of the user, the base behind the ear, and the receiver extending from the dome, over a top of the ear, to the base;

a hearing aid safety aid comprising a flexible elongate member, a small ring on a first end of the member, and a large ring on the opposite end of the member, the large ring defining an interior aperture large enough for the small ring to pass through;

wherein the hearing aid safety aid is looped around the receiver of the behind-the-ear hearing aid by the small ring being passed through the large ring about the receiver, forming a loop about the receiver, the small ring and member extending away from the receiver;

an earring having a post positioned in a pierced earlobe of the user's ear, the post extending through the small ring.

2. The hearing aid assembly of claim 1 wherein the elongate member is a chain.

3. The hearing aid assembly of claim 1 wherein the elongate member is a cable.

4. The hearing aid assembly of claim 1 wherein the elongate member is a string.

5. The hearing aid assembly of claim 1 wherein the earring further comprises a backer, the small ring secured to the post between the backer and the ear of the user.

6. The hearing aid assembly of claim 1 wherein the earring further comprises a charm, the small ring secured to the post between the charm and the ear of the user.

7. The hearing aid assembly of claim 1 wherein the earring further comprises a backer, the small ring secured to the post between the backer and the ear of the user.

8. The hearing aid assembly of claim 1 wherein the earring further comprises a charm, the small ring secured to the post between the charm and the ear of the user.

9. A hearing aid assembly comprising:

a behind-the-ear hearing aid comprising a base, and an elongate receiver comprising a dome at a distal end, and connecting to the base at a proximal end, the behind-the-ear hearing aid connected to an ear of a user, having the dome in an ear canal of the user, the base behind the ear, and the receiver extending from the dome, over a top of the ear, to the base;

a hearing aid safety aid comprising a flexible elongate member, a small ring on a first end of the member, and a large ring on the opposite end of the member, the large ring defining an interior aperture large enough for the small ring to pass through;

wherein the hearing aid safety aid is looped around the receiver of the behind-the-ear hearing aid by the small ring being passed through the large ring about the receiver, forming a loop about the receiver, the small ring and member extending away from the receiver.

10. The hearing aid assembly of claim 9 wherein the elongate member is a chain.

11. The hearing aid assembly of claim 9 wherein the elongate member is a cable.

12. The hearing aid assembly of claim 9 wherein the elongate member is a string.

13. The hearing aid assembly of claim 9 wherein the elongate member is connected to an earring.

14. The hearing aid assembly of claim 13 wherein the elongate member is removably connected to the earring.

15. The hearing aid assembly of claim 13 wherein the elongate member is permanently connected to the earring.

16. A hearing aid assembly comprising:

a behind-the-ear hearing aid comprising a base, and an elongate receiver comprising a dome at a distal end, and connecting to the base at a proximal end, the behind-the-ear hearing aid connected to an ear of a user, having the dome in an ear canal of the user, the base behind the ear, and the receiver extending from the dome, over a top of the ear, to the base;

a hearing aid safety aid comprising a flexible elongate member, and a small ring on a first end of the member;

wherein the hearing aid safety aid is connected to the receiver of the behind-the-ear hearing aid such that the small ring and member extend away from the receiver;

an earring having a post positioned in a pierced earlobe of the user's ear, the post extending through the small ring, thereby securing the hearing aid safety aid to the earring.

17. The hearing aid assembly of claim 16 wherein the elongate member is a chain.

18. The hearing aid assembly of claim 16 wherein the elongate member is a cable.

19. The hearing aid assembly of claim 16 wherein the elongate member is a string.

* * * * *